US009033155B2

(12) United States Patent
Sorhuus

(10) Patent No.: US 9,033,155 B2
(45) Date of Patent: May 19, 2015

(54) SCREENING DEVICE AND METHOD OF SCREENING

(75) Inventor: Anders Kenneth Sorhuus, Ski (NO)

(73) Assignee: ALSTOM Technology Ltd, Baden (CH)

( * ) Notice: Subject to any disclaimer, the term of this patent is extended or adjusted under 35 U.S.C. 154(b) by 41 days.

(21) Appl. No.: 13/807,763

(22) PCT Filed: Jun. 28, 2011

(86) PCT No.: PCT/IB2011/001512

§ 371 (c)(1),
(2), (4) Date: Mar. 11, 2013

(87) PCT Pub. No.: WO2012/001491

PCT Pub. Date: Jan. 5, 2012

(65) Prior Publication Data

US 2013/0206649 A1 Aug. 15, 2013

(30) Foreign Application Priority Data

Jun. 30, 2010 (EP) ..... 10167888

(51) Int. Cl.

*B07B 9/00* (2006.01)
*B07B 1/00* (2006.01)
*B03B 4/06* (2006.01)
(Continued)

(52) U.S. Cl.

CPC ... *B07B 1/00* (2013.01); *B03B 4/06* (2013.01); *B07B 1/04* (2013.01); *B07B 4/08* (2013.01)

(58) Field of Classification Search

USPC ..... 209/28, 29, 250, 265
See application file for complete search history.

(56) References Cited

U.S. PATENT DOCUMENTS 3,123,551 A * 3/1964 Walker ..... 209/29
3,796,312 A * 3/1974 Krolopp et al. ..... 209/312
4,319,990 A * 3/1982 Muller ..... 209/240
(Continued)

FOREIGN PATENT DOCUMENTS

CN 85101078 A 9/1985
JP 8299909 A 11/1996
(Continued)

OTHER PUBLICATIONS

International Search Report and Written Opinion, International Searching Authority, International Application No. PCT/IB2011/001512, Search completed Sep. 20, 2011, Authorized Officer Christian Psoch, mailed Sep. 26, 2011.
(Continued)

*Primary Examiner* — Joseph C Rodriguez

(57) ABSTRACT

A screening device (1) comprises a first compartment (3) for receiving solid particulate material, a second compartment (5) for receiving screened particulates from said first compartment (3), a perforated wall (7) separating the first (3) and second (5) compartments from each other for screening the solid particulate material into at least two particulate size-dependent fractions, and a gas permeable layer (21) for fluidization of particulates in said first compartment (3). The first compartment (3) is provided with a solid particulate material inlet (9) located at a first end (22) of screening device (1), and a particulate material outlet (11) located at a second end (24) of screening device (1), with perforated wall (7) extending from first end (22) to second end (24) of screening device (1), enabling simultaneous transport and screening of at least a portion of said solid particulate material.

9 Claims, 6 Drawing Sheets

(51) Int. Cl.
*B07B 1/04* (2006.01)
*B07B 4/08* (2006.01)

(56) References Cited

U.S. PATENT DOCUMENTS

| | | | | | |
|---|---|---|---|---|---|
| 4,619,761 | A | * | 10/1986 | Franzen | 209/250 |
| 4,652,362 | A | * | 3/1987 | Mueller | 209/44.2 |
| 4,678,560 | A | * | 7/1987 | Stole et al. | 209/23 |
| 5,348,161 | A | * | 9/1994 | Mueller | 209/29 |
| 2006/0163118 | A1 | | 7/2006 | Kelsey et al. | |
| 2009/0159434 | A1 | | 6/2009 | Girault et al. | |

FOREIGN PATENT DOCUMENTS

| | | | |
|---|---|---|---|
| JP | 2000065327 | A | 3/2000 |
| RU | 840173 | A1 | 6/1981 |
| SU | 1280035 | A1 | 12/1986 |

OTHER PUBLICATIONS

European Search Report, European Patent Application No. 10167888, Search completed Nov. 12, 2010, The Hague.

Office action issued from Chinese Patent Office dated Sep. 3, 2014 for CN Application No. 201180032604.9.

Office action issued from the Russian Federation Patent Office dated Dec. 16, 2014 for RU Application No. 2013103701.

* cited by examiner

SCREENING DEVICE AND METHOD OF SCREENING

This is a US National Phase application claiming priority to International Application No. PCT/IB2011/001512 having an International Filing Date of Jun. 28, 2011, incorporated herein in its entirety by reference.

TECHNICAL FIELD

The present invention relates to a screening device comprising a first compartment for receiving a solid particulate material to be screened, and a second compartment for receiving screened particulates from said first compartment.

The present invention further relates to a method of separating solid particulate material into at least two particulate size-dependent fractions.

TECHNICAL BACKGROUND

Screening of solid particulate materials to form separate fractions of differently sized particulates is undertaken for many purposes. One such purpose is to separate desired from undesired particulates from a solid particulate material containing each if such may be accomplished based on a size differential between the desired and the undesired particulates. An example of such is the removal of aluminium oxide powder, also called alumina powder, from a solid particulate material so the desired powder may be fed to, for example, an aluminium production electrolytic cell utilized in the production of aluminium as disclosed in US 2009/0159434. Screening of solid particulate material is typically done by passing the particulate material through a perforated screening plate. In this way, desired particulates of the desired size may be separated from the solid particulate material.

JP-8299909 discloses a fluidized bed chamber having a vertical plate, which operates as a screening plate to separate particles into a fine particle fraction and a coarse particle fraction. Particles of both sizes are introduced into the fluidized bed chamber and pass through the screening plate into a take off chamber having separate take off ports for each fine particles and coarse particles. However, the screening device disclosed in JP-8299909 is considered inefficient and may provide inaccurate screening.

SUMMARY OF THE INVENTION

It is an object of the present invention to overcome at least some of the above-described deficiencies, and to provide an improved screening device.

This and other objects that will become apparent from the following summary and detailed description, are achieved by a screening device according to the appended claims.

According to one embodiment a screening device according to the preamble may comprise a perforated wall for separating first compartment and second compartment from each other and for screening the solid particulate material into at least two particulate size-dependent fractions, and a gas permeable layer for fluidization of particulates to simultaneously transport particulates through said screening device along said perforated wall and screen particulates within said screening device.

According to one embodiment of the subject screening device, there is provided a screening device comprising a first compartment for receiving a solid particulate material to be screened, a second compartment fluidly connected to the first compartment for receiving screened particles from the first compartment, a perforated wall positioned lengthwise between the first compartment and the second compartment to at least partially separate first and second compartments from each other and to screen solid particulate material into at least two different size fractions, perforations of a predetermined size extending through the thickness of the perforated wall and configured so that particles of a size larger than that of the perforations are prevented from passing through the perforations of the perforated wall, and a gas permeable layer for fluidization of particulates within the subject screening device. The first compartment may be provided with a particulate material inlet located in a first end of the screening device. A particulate material outlet is located in a second end of the screening device. The perforated wall positioned adjacent to the particulate material inlet and the particulate material outlet extends lengthwise between the first end and the second end of the screening device to at least partially separate the first compartment from that of the second compartment. The subject screening device as just described enables simultaneous screening and transport of at least a portion of said solid particulate material.

In using the subject screening device just described, a solid particulate material is conveyed into the screening device through the particulate material inlet. Particulate material entering the screening device through particulate material inlet thus enters the interior of the first compartment of said screening device. Particulate material in the interior of the first compartment is transported through the perforations in the perforated wall and into the interior of the second compartment. However, those particulates of particulate material too large to pass through perforations in the perforated wall are transported out of the interior of the first compartment through an outlet port. Smaller particulates in the second compartment interior are transported out of the second compartment via the particulate material outlet. Accordingly, particulate material screening and transport are accomplished simultaneously. Hence, a very space-efficient screening device is provided. A further advantage of the present screening device is that the particulates are subjected to limited, or no, grinding, since the screening process occurs with the particulates in a fluidized state. Hence, the individual particulates will stay substantially unaffected during the screening process, and formation of fines dust will be limited.

Additionally, by forcing pressurized air, through the gas permeable layer fluidly connected to the first compartment and, optionally, to the second compartment, the solid particulate material, in the interior of the first and second compartments, may become fluidized thus behaving in a manner similar to that of a fluid. Gas flow through the gas permeable layer thus enables so-called fluidization of particulate material introduced into the subject screening device. Fluidization of the particulate material ensures effective screening and transport of the particulate material through the screening device. The perforated wall prevents larger sized particles and/or items from entering the interior of the second compartment. Accordingly, a fine particle fraction separated from the particulate material through screening may be discharged or collected from the interior of the second compartment.

According to one embodiment the first compartment is provided with a particulate material inlet located adjacent to a first end of the screening device and a particulate material outlet located adjacent to a second end of the screening device, the perforated wall extending from the first end to the second end of the screening device, thereby enabling simultaneous transport of at least a portion of said solid particulate material and screening of said solid particulate material.

With regard to the subject screening device, the longest length to widest width ratio of the first compartment is preferably at least 3:1. An advantage of such an embodiment with a longest length to widest width ratio of at least 3:1 makes the screening and transporting of particulate material very efficient, since almost all particulates having a size which is smaller than the size of the perforations in the perforated wall quickly pass through the perforated wall's perforations and into the interior of the second compartment, instead of remaining in the first compartment together with the larger sized particulates.

In one embodiment, the gas permeable layer or base of the first compartment slopes downward away from the particulate material inlet thus improving the transport of particulate material from the first end to the second end of the screening device. Alternatively, or in combination with the gas permeable layer or base of the first compartment sloping downward away from the particulate material inlet, the entire screening device may be manufactured to slightly slope downward, away from the first end of the screening device, with respect to a horizontal plane.

Preferably the second compartment is also provided with a gas permeable layer for fluidization of particles accommodated therein, although the same is not mandatory. Transport of the screened smaller sized particulates along the longitudinal direction of the screening device in a very efficient manner is thereby enabled. The particulates entering the second compartment are thus not only separated from larger particles of the solid particulate material introduced in the first compartment but also transported in a longitudinal direction from the first end toward the second end of the screening device.

In an alternative embodiment a gas chamber is arranged below the gas permeable layer. Fluidizing gas flows from the gas chamber through the gas permeable layer to the first and second compartments. According to one embodiment, the gas chamber comprises a first sub-chamber supplying fluidization gas to the first compartment, and a second sub-chamber being separated from the first sub-chamber and supplying fluidization gas to the second compartment. This embodiment has the advantage that the supply of gas to each of the compartments can be controlled and optimized with respect to the type and amount of material accommodated in each one of the compartments.

According to one embodiment, each of the perforations through the perforated wall is of a uniform size. An advantage of this embodiment is that it is easier to predict what size particulates will pass through the perforated wall and enter the second compartment, and what size particulates will remain in the first compartment.

It is a further object of the present invention to provide an improved method of screening a solid particulate material.

This object is achieved by means of a method of separating solid particulate material into at least two particulate size-dependent fractions, said method comprising:

supplying pressurized gas to first compartment of a screening device for fluidization of at least a portion of a solid particulate material therein to simultaneous transport said solid particulate material through said screening device along a perforated wall and screen at least a portion of the solid particulate material through perforated wall, to obtain separated larger sized unscreened particulates and smaller sized screened particulates.

According to one embodiment the method comprises introducing said solid particulate material into a first compartment of a screening device supplied with a pressurized gas via a gas permeable layer for fluidization of at least a portion of the solid particulate material accommodated in the first compartment, and simultaneously screening at least a portion of the solid particulate material through a perforated wall extending from a first end to a second end of the screening device to separate said first compartment from a second compartment of said screening device for separation of larger sized particulates remaining in the first compartment from screened smaller sized particulates accommodated in the second compartment and transporting the larger sized particulates and smaller sized particulates toward the second end of the screening device.

An advantage of this method is that the screening occurs simultaneously with the transporting of the particulate material in a fluidized state along/through the perforated wall which results in a very efficient screening process requiring little energy input. In this method, the energy consumed is mainly in the supply of pressurized gas through the gas permeable layer used to transport and screen the particulate material.

The level of particulate material in first compartment is preferably greater than that in second compartment in at least one vertical cross section of the screening device, thereby generating a material flow of particulates from first compartment to second compartment. Having a greater level of particulate material in the first compartment than the second compartment improves the flow of smaller sized particles from the first compartment to the second compartment.

According to one embodiment, the method further comprises the step of supplying pressurized gas to said second compartment of the screening device through said gas permeable layer for fluidization of at least a portion of the screened smaller sized particulates accommodated in the second compartment. An advantage of this embodiment is that the material that has passed through the perforated wall is directly fluidized and transported by means of the pressurized gas.

According to one embodiment, the method further comprises fluidizing the material accommodated in the first compartment independently of the material accommodated in the second compartment. An advantage of this embodiment is that the degree of fluidization, and the level of material, in the first and second compartments can be adjusted independently of each other, such that efficient screening and transport of the particulate material can be achieved.

It is to be noted that the invention relates to all possible combinations of features recited in the claims. Further advantages and features of the invention will be apparent from the following detailed description, drawings and appended claims.

BRIEF DESCRIPTION OF THE DRAWINGS

The present invention will now be described in more detail with reference to the accompanying drawings, which illustrate embodiments thereof in which.

DETAILED DESCRIPTION OF PREFERRED EMBODIMENTS OF THE INVENTION

As used herein, "solid particulate material" refers to various known compositions of solid particulate materials, such as aluminium oxide powder, the latter having a typical particle size in the range of 10-150 μm.

Figure 1A:
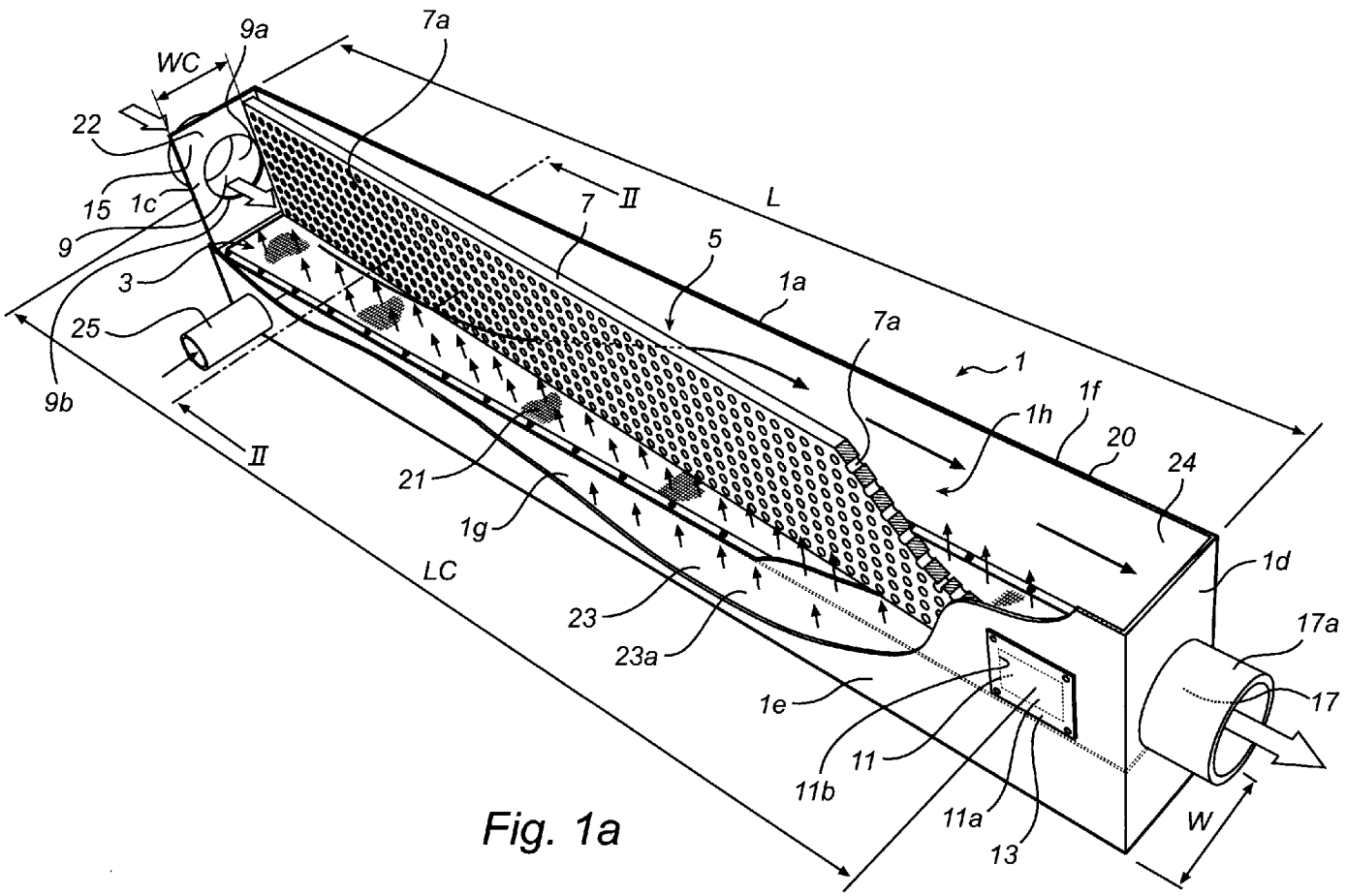
FIG. 1*a* is a perspective view illustrating a screening device according to a first embodiment of the present invention, wherein a top and a portion of a side of the device is removed to expose an interior portion thereof.
Figure 1B:
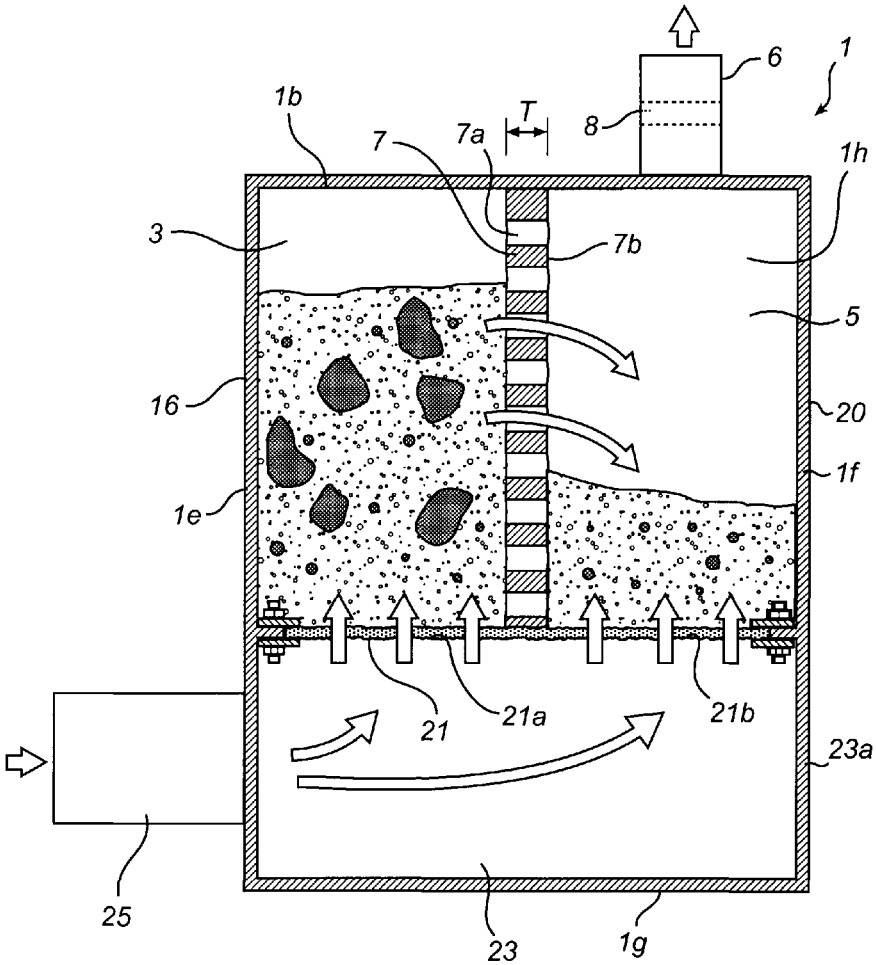
FIG. 1*b* is a cross sectional view of the screening device of FIG. 1*a* taken along line II-II.

FIGS. 1*a* and 1*b* illustrate a screening device 1 according to a first embodiment. The screening device 1 comprises an exterior body 1*a* defined by a top 1*b*, which has been removed in FIG. 1*a*, but which is shown in FIG. 1*b*, opposed first and second sides 1*c* and 1*d* attached perpendicularly to top 1*b*, opposed walls 1*e* and 1*f* attached perpendicularly to top 1*b* and attached to sides 1*c* and 1*d*, and a base 1*g* attached to both sides 1*c* and 1*d* opposite top 1*b* and attached to both walls 1*e* and 1*f* opposite top 1*b*. Within interior 1*h* of exterior body 1*a* is a first compartment 3 for receiving solid particulate material to be screened, a second compartment 5 for receiving screened material from the first compartment 3, and a perforated wall 7 separating the first and second compartments, 3 and 5 respectively, from each other.

As is best illustrated in FIG. 1*a*, the first compartment 3 is provided with a particulate material inlet 9, in the form of an inlet channel 9*a*, through which solid particulate material to be screened may be introduced into the screening device 1, and a particulate material outlet 11, in the form of an aperture 11*a* covered by a removable cover plate 13, through which larger sized particulate material may be periodically removed from first compartment 3 of interior 1*h* of screening device 1.

Inlet channel 9*a*, located in side 1*c* of screening device 1, may, e.g., be connected to a material conveyor suitable to continuously supply solid particulate material to first compartment 3 of screening device 1.

The second compartment 5 is provided with a screened particulate material outlet 17, in the form of an outlet channel 17*a*, through which screened smaller sized particulates exit screening device 1. The outlet channel 17*a*, located in side 1*d* of screening device 1, may be connected to a material conveyor suitable to continuously remove screened material from screening device 1 and feed the same to, for example, an aluminium production electrolytic cell.

Screening device 1 further comprises within interior 1*h* a gas permeable layer 21 and a gas chamber 23, as best illustrated in FIG. 1*b*. The gas chamber 23 is arranged in the bottom portion 23*a* of screening device 1 and is separated from each of the first and the second compartments, 3 and 5 respectively, by the gas permeable layer 21. The gas permeable layer 21, which may be made of a gas-permeable fabric, forms a base 21*a* of first compartment 3 and a base 21*b* of second compartment 5. The gas chamber 23 is fluidly connected to a gas inlet 25 through which pressurized gas, such as pressurized air or nitrogen gas, may be supplied from a source of pressurized gas (not shown). The gas chamber 23 is thus capable of supplying pressurized gas to each of the compartments 3 and 5 through gas permeable bases 21*a* and 21*b*, respectively.

The pressurized gas in the gas chamber 23 applies a force on the gas permeable layer 21, which force presses the gas permeable layer 21 against the lower edge of the perforated wall 7. Hence, the gas permeable layer 21 abuts the perforated wall 7 in a sealing manner without the need of additional means for fastening the gas permeable layer 21 to the perforated wall 7.

The second compartment 5 is fluidly connected to a venting duct 6 through which gas may be discharged from the interior of the second compartment 5. The venting duct 6 is provided with a filter 8 for filtering gas that exit the second compartment 5 through the venting duct 6.

As is best illustrated in FIG. 1*a*, and previously described, the screening device 1 has two elongated walls 1*e* and 1*f* connected to the two sides 1*c* and 1*d*. Each of the two elongated walls 1*e* and 1*f* has lengths L, which are longer than the lengths W of either of the two sides 1*c* and 1*d*. Hence, the screening device 1 has an elongated shape, with a width, corresponding to the lengths W of the sides 1*c* and 1*d*, which is less than its length, corresponding to the lengths L of the walls 1*e* and 1*f*.

Solid particulate material is fed to the screening device 1 via the inlet channel 9*a* and is transported through the screening device 1 from a first end 22 thereof, said first end 22 being located adjacent to the first side 1*c*, to a second end 24 thereof, said second end 24 being located adjacent to the second side 1*d*.

The first compartment 3 has a compartment length LC that is almost the same as the length L of the elongated walls 1*e* and 1*f*, and a widest compartment width WC, adjacent to the first end 22 of the screening device 1, which is almost the same as the widths W of sides 1*c* and 1*d*. The compartment length LC is the distance from the closest edge 9*b* of inlet 9 to the closest edge 11*b* of aperture 11*a*. Hence, the material that cannot pass through perforated wall 7 will travel the distance LC from inlet 9 to aperture 11*a* along perforated wall 7. Preferably the ratio of the compartment length LC to the widest compartment width WC of the first compartment 3 is at least 3:1. Hence, the length LC of the first compartment 3 is preferably at least 3 times that of the widest compartment width WC of first compartment 3.

Perforated wall 7 extends from the first end 22 to the second end 24 of the elongated screening device 1. The size of the perforations 7*a*, illustrated in FIG. 1*b*, through the thickness T of perforated wall 7 is adapted to prevent particulates larger than a predetermined size from passing through into second compartment 5. Particulates of a size smaller than the size of the perforations 7*a* are able to pass through perforations 7*a* in perforated wall 7 and enter second compartment 5. The size of perforations 7*a* is chosen based on the composition of the solid particulate material to be screened and may thus be optimized to achieve a certain purpose. In the present embodiment the perforated wall 7 is formed by a 3 mm thick steel plate and each of the perforations are circular in shape having a diameter of 8 mm. Perforations 7*a* are uniformly distributed over the surface 7*b* of perforated wall 7. In screening device 1, perforated wall 7 is substantially vertical so as to contact top 1*b* perpendicularly, as best shown in FIG. 1*b*. As alternative, perforated wall 7 may be angled toward a horizontal plane and thereby contact top 1*b* at an angle.

Perforated wall 7 may be arranged at an angle with regard to the longitudinal axis of screening device 1, as illustrated in FIG. 1*a*. A cross sectional area taken perpendicular to the longitudinal axis of screening device 1 adjacent to the first end 22, would have a larger first compartment 3 than the same taken adjacent to the second end 24. Thus, the cross sectional area of the first compartment 3 decreases in its downstream direction, i.e., in a direction moving from first end 22 toward second end 24 of screening device 1, as best illustrated in FIG. 1*a*. Conversely, the cross sectional area of the second compartment 5 gradually increases in its downstream direction, i.e., in a direction moving from first end 22 toward second end 24 of screening device 1.

The gas permeable layer 21 is in this embodiment horizontal. Alternatively, it may be slightly sloping with respect to a horizontal plane in order to further improve the transport of material from the first end 22 to the second end 24 of the screening device 1. As an alternative to, or in combination with, a sloping gas permeable layer the screening device itself may be slightly sloping with respect to a horizontal plane. In each such case, the slope should be arranged such that the particulate material experiences a downhill slope when being transported from the first end 22 to the second end 24.

By supplying pressurized gas to gas chamber 23 and allowing this gas to pass upwardly through gas permeable layer 21 and into first compartment 3, the solid particulate material in first compartment 3 becomes fluidized, and creates a so-called "fluidized bed" wherein particulates therein behave as a fluid, as best illustrated in FIG. 1*b*.

Gas permeable layer 21 is configured to achieve fluidization of at least particles accommodated inside first compartment 3. In the embodiment of FIGS. 1*a* and 1*b*, gas chamber 23 and gas permeable layer 21 extends above and over the entire area of base 1*g* in interior 1*h* of screening device 1 in order to enable fluidization of particles in both first and second compartments 3 and 5, respectively. Pressurized gas introduced into gas chamber 23 via gas inlet 25 is distributed to both first compartment 3 and second compartment 5 via gas permeable layer 21.

The amount of material in first compartment 3 is greater than the amount of material in second compartment 5, as illustrated in FIG. 1*b*. Due to gravity, the greater amount of material in first compartment 3 contributes to a material flow of smaller sized particulates through perforated wall 7 in a direction toward second compartment 5. Consequently, smaller sized particulates of a size smaller than the size of the perforations 7*a* in perforated wall 7, flow from first compartment 3 to second compartment 5. Larger sized particulates of a size larger than the size of the perforations 7*a* in perforated wall 7, are retained in first compartment 3, and eventually transported toward aperture 11, adjacent to second end 24 of screening device 1. Occasionally, cover plate 13 is removed from aperture 11, for removal of larger sized particulates from first compartment 3.

As long as solid particulate material is continuously introduced into first compartment 3 at first end 22 of screening device 1, fluidized particulates are transported through screening device 1 toward second end 24. This fluidization of particulates efficiently enables the particulates to be transported in a longitudinal direction within screening device 1 with simultaneous screening thereof. Particulates are transported toward second end 24 of screening device 1 at least as long as there is material flow into first compartment 3. Likewise, the fluidization of particulates in first compartment 3 results in an efficient mixing of the particulates aiding in the flow of smaller sized particulates through perforated wall 7 and into second compartment 5. Fluidization of particulates in first compartment 3 also aids in the separation of larger sized particulates from smaller sized particulates. The smaller sized particulates exit second compartment 5 via outlet channel 17*a* and may be transported to a storage facility or directly to a production facility, such as an aluminium production electrolytic cell (not shown).

Hence, the first compartment 3 is provided with a particulate material inlet 9 located adjacent to a first end 22 of the screening device 1, and a particulate material outlet 11 located adjacent to a second end 24 of the screening device 1, the perforated wall 7 extending from the first end 22 to the second end 24 of the screening device 1, thereby enabling simultaneous transport of at least a portion of said solid particulate material and screening of said solid particulate material.

Figure 2:
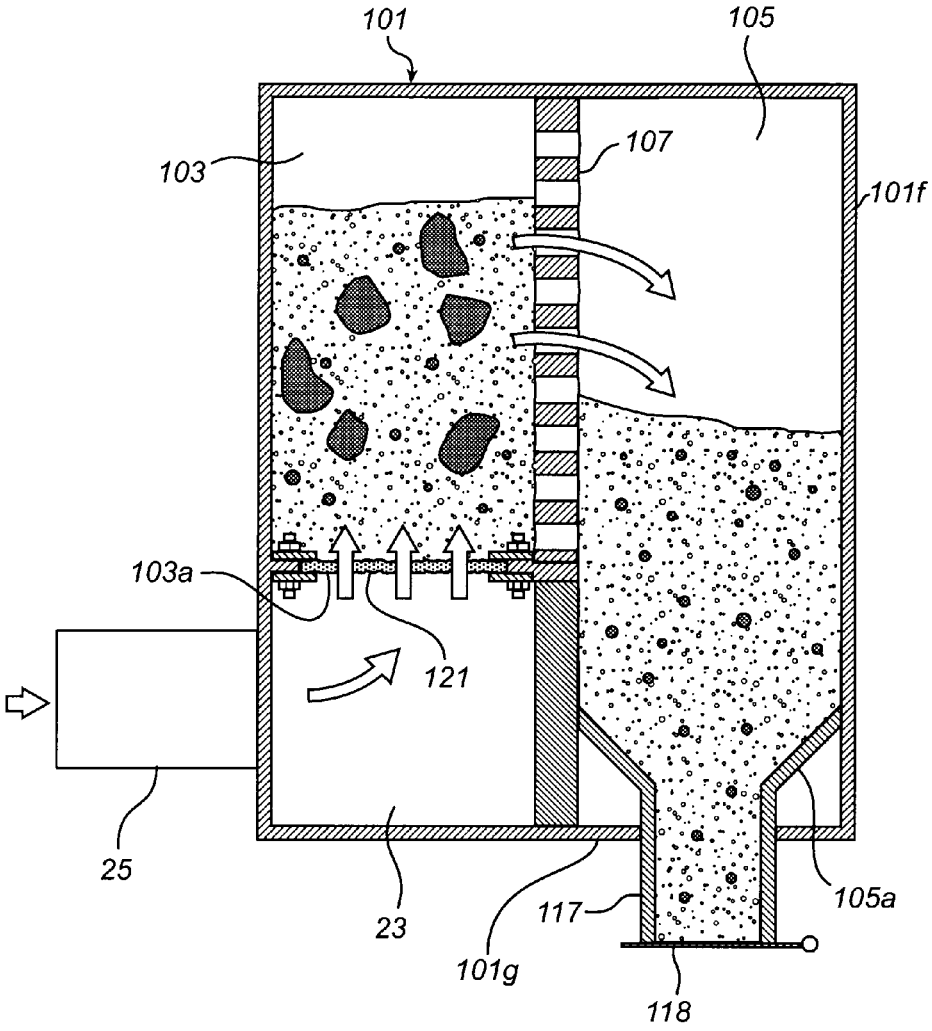
FIG. 2 is a cross sectional view of a screening device according to a second embodiment of the present invention.

FIG. 2 illustrates a screening device 101 according to a second embodiment. Many features disclosed in first embodiment screening device 1 are also present in the second embodiment with similar reference numerals identifying similar or same features. Having mentioned this, the description will focus on explaining the differing features of the second embodiment. The second embodiment differs from the first embodiment in that only first compartment 103 is provided with gas permeable layer 121, such that only the solid particulate material in first compartment 103 can be fluidized. It is thus not possible to fluidize the smaller sized particulates accommodated within second compartment 105. Furthermore, screening device 101 differs from screening device 1 in that outlet 117 of second compartment 105 extends along the length of second compartment 105, i.e., it extends from first end to second end of screening device 101 and projects downwardly and outwardly through base 101*g*. Outlet 117 which connects to base 105*a* of second compartment 105, preferably connects to base 105*a* in a horizontal plane below that of gas permeable layer 121 which forms the base 103*a* of first compartment 103. Base 105*a* of second compartment 105 preferably angles inwardly from perforated wall 107 and elongated wall 101*f* and downwardly toward connection with outlet 117. This downwardly sloping angle of base 105*a* serves to guide smaller sized particulates within second compartment 105 toward outlet 117 and exit therethrough. Outlet 117 is covered by a removable plate 118 which can be removed in order to allow screened material to be occasionally discharged from screening device 101.

Alternatively, screened material entering second compartment 105 may drop directly down into a silo or onto a conveying device arranged below second compartment 105. In the latter case, second compartment 105 may have multiple outlets 117 along the length of base 105*a* of screening device 101.

Figure 3:
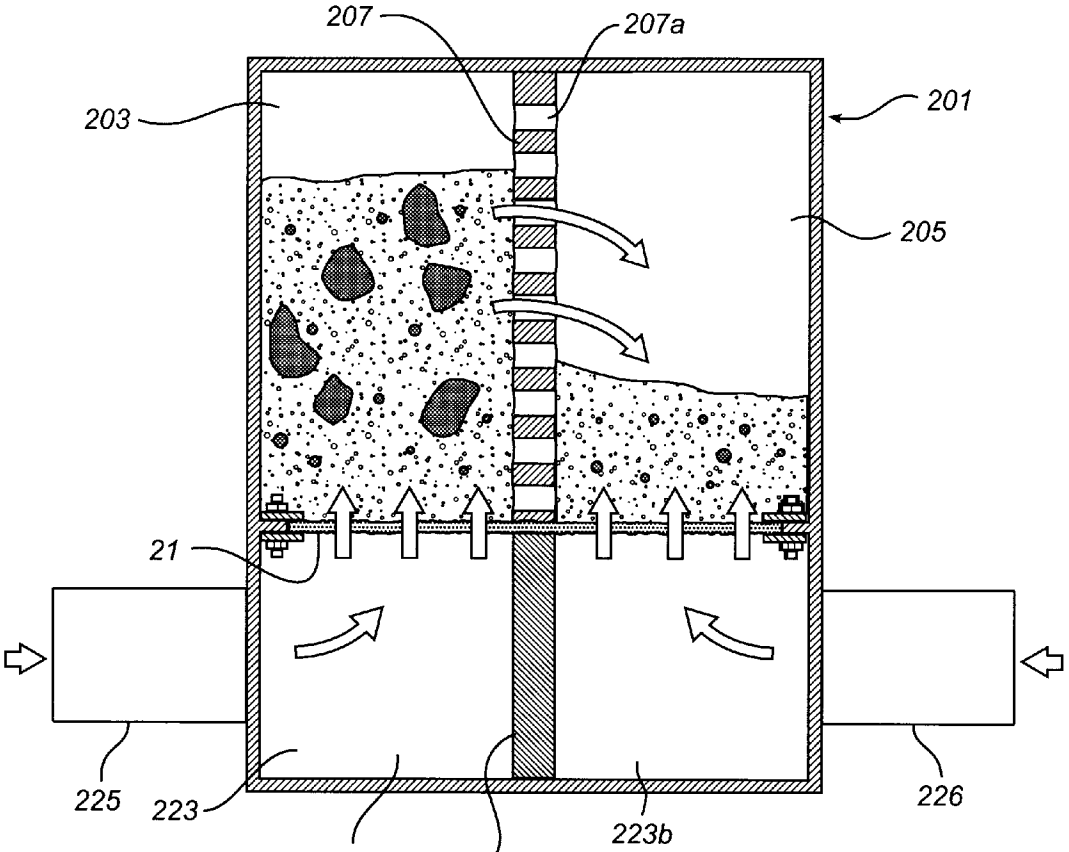
FIG. 3 is a cross sectional view of a screening device according to a third embodiment of the present invention.

FIG. 3 illustrates a screening device 201 according to a third embodiment. Many features disclosed in the first embodiment are also present in the third embodiment with similar reference numerals identifying similar or same features. Having mentioned this, the description below will focus on explaining the features of the third embodiment that differ from those of the first embodiment. The screening device 201 differs from the screening device 1 in that gas chamber 223 is divided into a first sub-chamber 223*a* and a second sub-chamber 223*b* separated from each other by a wall 227. Each one of the sub-chambers 223*a* and 223*b* is provided with a gas inlet 225 and 226, respectively, through which pressurized gas may be supplied from separate gas reservoirs (not shown). Each of the sub-chambers, 223*a* and 223*b*, may thus be fluidly connected to an individual source of pressurized gas, creating an advantage in that the pressure, and hence, the degree of particulate fluidization inside each of compartments 203 and 205 may be optimized with regard to the particulate material accommodated therein. Hence, the gas pressure in first sub-chamber 223*a* may be set to a higher pressure than that of second sub-chamber 223*b*, to obtain a more vigorous fluidization of the particulates in first compartment 203 than that in second compartment 205. A more vigorous fluidization of the particulates in first compartment 203 than that in second compartment 205 increases the driving force transporting smaller sized particulates from first compartment 203, through perforations 207*a* in perforated wall 207, and into second compartment 205.

Figure 4:
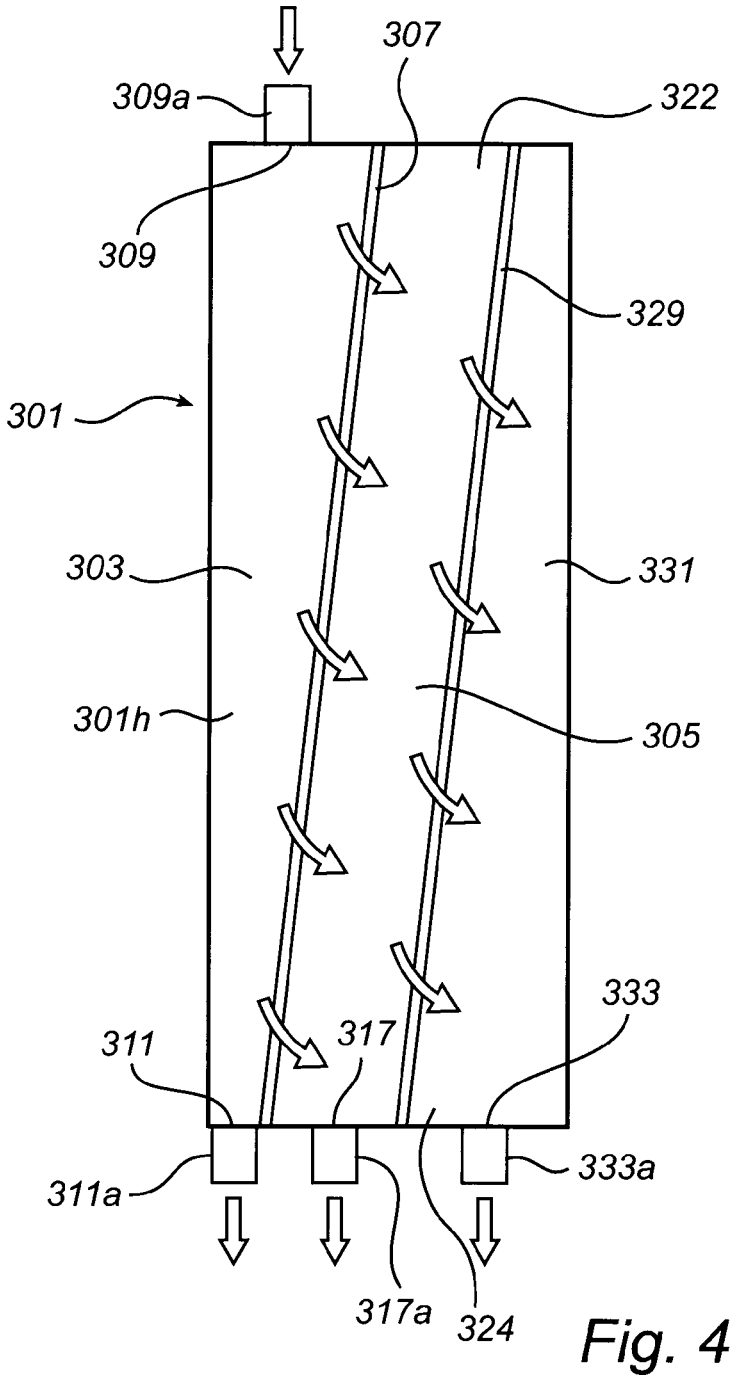
FIG. 4 is a top plan view of a screening device according to a fourth embodiment of the present invention, wherein a top is removed to expose an interior portion thereof.

FIG. 4 illustrates screening device 301 in top plan view with its top removed so as to illustrate interior 301*h* thereof according to a fourth embodiment. Many features disclosed in the first embodiment are also present in the fourth embodiment with similar reference numerals identifying similar or same features. Having mentioned this, the description below will focus on explaining the features of the fourth embodiment differing from those of the first embodiment. The screening device 301 differs from the screening device 1 in that the screening device 301 in addition to a first compartment 303 and a second compartment 305, being separated from each other by means of a first perforated wall 307, comprises a second perforated wall 329 and a third compartment 331. The third compartment 331 is separated from the second compartment 305 by the second perforated wall 329 having perforations that are smaller in size than perforations of first perforated wall 307. Hence, second perforated wall 329 is adapted to prevent particulates larger than a predetermined size from passing through perforations of second perforated wall 329 and into third compartment 331.

An inlet channel 309*a* is fluidly attached to inlet 309 through which solid particulate material may be introduced into first compartment 303. Inlet 309 is arranged in a first end 322 of screening device 301. First compartment 303 is also provided with a particulate material outlet 311 fluidly connected to or integrally formed with an outlet channel 311*a*, arranged in a second end 324 of screening device 301. Furthermore, second compartment 305 is provided with an outlet 317 fluidly connected to or integrally formed with an outlet channel 317*a* arranged in second end 324 of screening device 301, and third compartment 331 is provided with an outlet 333 fluidly connected to or integrally formed with an outlet channel 333*a* arranged in second end 324 of screening device 301. Screening of the solid particulate material introduced into first compartment 303 allows smaller sized particulates to pass through perforations of first perforated wall 307 and enter into second compartment 305. The particulate material thus entering into second compartment 305 via first perforated wall 307 is screened allowing smaller sized particulates to pass through perforations of second perforated wall 329 and enter into third compartment 331. Solid particulate material introduced into first compartment 303 may thus be separated into three fractions of particulates differing in size. If, for example, the perforations of first perforated wall 307 have a diameter of 8 mm, and the perforations of second perforated wall 329 have a diameter of 4 mm, then only particulates having a size smaller than 4 mm may exit third compartment 331 via outlet channel 333*a*. Particulates 4-8 mm in size may exit second compartment 305 via outlet channel 317*a*, and particulates 8 mm and larger in size exit first compartment 303 via outlet channel 311*a*.

Both perforated walls 307 and 329 extend longitudinally from first end 322 to second end 324 of screening device 301. Hence, the screening of particulate material introduced into first compartment 303 at first end 322 of screening device 301 commences simultaneously with the transporting of particulate material from first end 322 to second end 324 of screening device 301.

It is realized that any number of additional perforated walls may be added to screening device 301 to enable separation of particulates into a greater number of size-dependent fractions.

Figure 5:
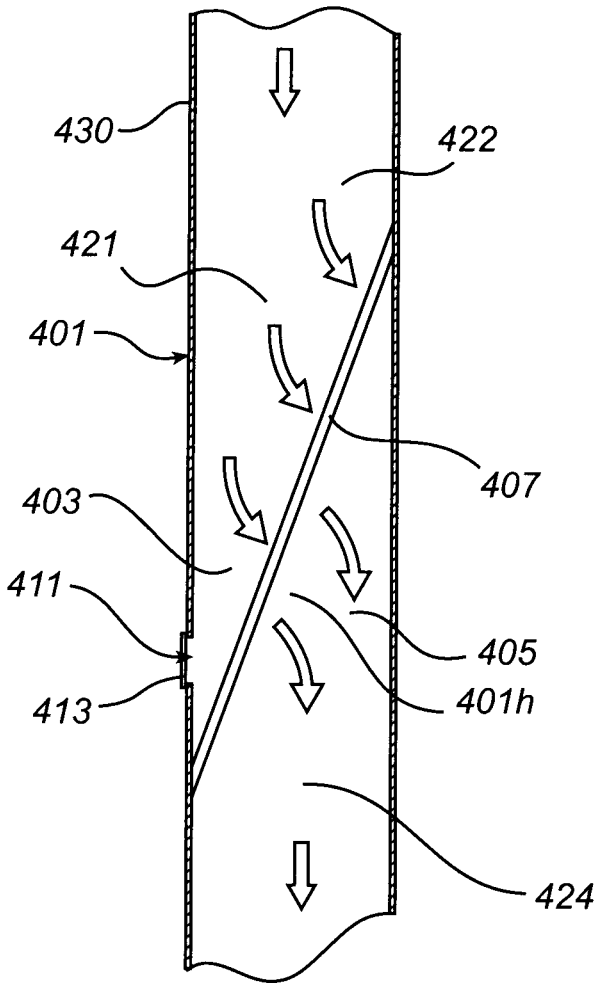
FIG. 5 is a top plan view of a screening device according to a fifth embodiment of the present invention, wherein a top is removed to expose an interior portion thereof.

FIG. 5 illustrates screening device 401 in top plan view with its top removed so as to illustrate interior 401*h* thereof according to a fifth embodiment. Many features disclosed in the first embodiment are also present in the fifth embodiment with similar reference numerals identifying similar or same features. Having mentioned this, the description below will focus on explaining the features of the fifth embodiment differing from those of the first embodiment. The screening device 401 differs from the screening device 1 in that the screening device 401 is fully integrated into a particulate transport chute 430 which is operative for transporting particulate matter in a substantially horizontal direction from one position to another, for example from an alumina silo to an aluminium production electrolytic cell. The transport chute 430 is provided with a gas permeable layer 421 extending along the transport chute 430 and also along the screening device 401. Pressurized gas is supplied, in a similar manner as described hereinbefore with reference to FIG. 1*b*, from below gas permeable layer 421 to fluidize particulate material such that the particulate material will flow substantially horizontally along transport chute 430. The transport of particulate material in transport chute 430 occurs according to the well-known air slide principle of transporting fluidized material. The screening device 401 comprises a perforated wall 407 which extends from a first end 422 to a second end 424 of the screening device 401, with the first end 422 being located upstream of second end 424, as seen in the direction of particulate transport. The perforated wall 407 separates a first compartment 403 from a second compartment 405. As can be seen the cross section of screening device 401 is the same as that of transport chute 430, making the screening device 401 fully integrated with transport chute 430. Particulate material to be screened enters, via transport chute 430, first compartment 403 at first end 422 of screening device 401. Particulates of a size smaller than the size of perforations of perforated wall 407 are able to pass through perforations in perforated wall 407 and enter second compartment 405, from which such particulate material is transported further, via second end 424 and transport chute 430, to its intended destination, as indicated by arrows in FIG. 5. Particulates of a size larger than the size of the perforations in perforated wall 407 are retained in first compartment 403, and eventually transported toward aperture 411, adjacent to second end 424 of screening device 401. Occasionally, cover plate 413 is removed from aperture 411, for removal of larger sized particulates from first compartment 403. Hence, with screening device 401 the simultaneous transport and screening of material is integrated in the transport chute 430 resulting in a compact and efficient design.

In the following, a method of separating a smaller sized particulate fraction from a solid particulate material comprising a larger to smaller sized particulate gradient is described.

Referring to FIGS. 1*a* and 1*b*, a solid particulate material is introduced into screening device 1 through inlet channel 9*a* located at the first end 22. In addition to particulates of the desired size, the solid particulate material to be screened may comprise unwanted larger particles and/or items. Such unwanted larger particles and/or items may comprise stones, large aggregates of particulates, working gloves, tools and/or generally oversized particulates.

At least a portion of the solid particulate material introduced into first compartment 3 of screening device 1 is fluidized by gas supplied to first compartment 3 via gas permeable layer 21.

At least as long as particulate material is continuously introduced into first compartment 3 via inlet channel 9*a*, fluidized particulate material will be transported downstream, i.e. in a longitudinal direction toward second end 24 of screening device 1.

Simultaneously with fluidized particulate material transport from first end 22 to second end 24, particulates sized smaller than that of perforations 7*a* through perforated wall 7, pass through perforated wall 7 and into second compartment 5.

In this embodiment, particles accommodated in second compartment 5, i.e. the smaller sized particulates, are fluidized and transported toward second end 24 of screening device 1.

The separated smaller sized particulates are then discharged from second compartment 5 via outlet 17. Larger sized particulates may be removed from first compartment 3 via the opening 11 located at second end 24 of screening device 1.

To summarize, screening device 1 comprises a first compartment 3 for receiving solid particulate material, a second compartment 5 for receiving screened particulates from said first compartment 3, a perforated wall 7 separating the first 3 and second 5 compartments from each other for screening the solid particulate material into at least two particulate size-dependent fractions, and a gas permeable layer 21 for fluidization of particulates in said first compartment 3. The first compartment 3 is provided with a solid particulate material inlet 9 located at a first end 22 of screening device 1, and a particulate material outlet 11 located at a second end 24 of screening device 1, with perforated wall 7 extending from first end 22 to second end 24 of screening device 1, enabling simultaneous transport and screening of at least a portion of said solid particulate material.

The person skilled in the art realizes that the present invention by no means is limited to the specific embodiments described above. On the contrary, many modifications and/or variations are possible within the scope of the appended claims. It will be appreciated that the embodiments described herein may be modified and/or varied by a person skilled in the art without departing from the inventive concept defined by the claims below. Likewise, it is realized by a person skilled in the art that features from various embodiments disclosed herein may be combined with one another in order to provide further alternative embodiments.

For instance, outlet 11*a* of first compartment 3 may be provided with one or more additional screening devices to minimize the amount of smaller sized particulates removed together with the larger sized particulates.

In the embodiment illustrated in FIGS. 1*a* and 1*b*, first compartment 3 is provided with an aperture 11 through which larger sized particulates may be removed manually after removing cover plate 13. Alternatively, an outlet channel may be fluidly connected to outlet 11*a* for a continuous discharge of larger sized particulates from screening device 1.

Illustrated in FIG. 1*a*, perforated wall 7 extends from first side 1*c* to second side 1*d*. It will be appreciated that a screening device 1 could also be provided with a perforated wall 7 that extends along only a portion of the distance from first side 1*c* to second side 1*d* with other means for separating first compartment 3 from second compartment 5, and/or with a perforated wall 7 that is perforated only along a portion of its length. In the latter case, a first end of the screening device is the starting point of perforations through the perforated wall, and a second end of the screening device is the end of the perforations through the perforated wall.

It is realized that screening device 1 may form part of a channel system feeding particulate material to, e.g., a furnace, an electrolytic cell, an oven, etc. For instance, screening device 1 may form part of a feeding system for feeding a furnace of a metal production process with screened particulate material.

The screening device may be provided with indicator means for indicating the amount of particulate material in first compartment 3 and/or second compartment 5.

Gas permeable layer 21 is in the described embodiments formed by a gas permeable fabric. Alternatively, gas-permeable layer 21 may be formed from a metal material, e.g. in the form of a wire mesh or a thin perforated metal plate.

The invention claimed is:

1. A screening device comprising:

a first compartment for receiving a solid particulate material to be screened;

a second compartment for receiving screened particulates from the first compartment;

a perforated wall for separating the first compartment and the second compartment from each other and for screening the solid particulate material into at least two particulate size-dependent fractions; and a gas permeable layer of the first compartment for fluidization of solid particulate material and screened particulates to simultaneously transport the solid particulate material and screened particulates through the screening device along the perforated wall within the screening device, wherein the second compartment includes a second gas permeable layer for fluidization of screened particulates therein.

2. The screening device according to claim 1, wherein a ratio of a length to a widest width of the first compartment is at least 3:1.

3. The screening device according to claim 1, wherein the gas permeable layer and the second pas permeable layer slope downwardly in a direction moving from a first end to a second end of the screening device.

4. A screening device comprising:

a first compartment for receiving a solid particulate material to be screened;

a second compartment for receiving screened particulates from the first compartment;

a perforated wall for separating the first compartment and the second compartment from each other and for screening the solid particulate material into at least two particulate size-dependent fractions; and a gas permeable layer for fluidization of solid particulate material and screened particulates to simultaneously transport the solid particulate material and screened particulates through the screening device along the perforated wall within the screening device, wherein a gas chamber is arranged below the gas permeable layer for a flow of fluidization gas to the first compartment and the second compartment, and the gas chamber comprises a first sub-chamber for a flow of fluidization gas to the first compartment, and a second sub-chamber fluidly separated from the first sub-chamber, for a flow of fluidization gas to the second compartment.

5. The screening device according to claim 1, wherein perforations through the perforated wall are of a uniform size.

6. The screening device according to claim 1, wherein an additional perforated wall with perforations therethrough separates the second compartment from a third compartment, with the additional perforated wall extending from a first end to a second end of the screening device, with perforations therethrough smaller in size than the perforations through the perforated wall separating the first compartment from the second compartment.

7. A method of separating solid particulate material into at least two particulate size-dependent fractions, said method comprising:

supplying pressurized gas to a first compartment of a screening device through a gas permeable layer of the first compartment for fluidization of at least a portion of a solid particulate material therein to simultaneously transport the solid particulate material through the screening device along a perforated wall with perforations therethrough and screen at least a portion of the solid particulate material through the perforations in the perforated wall, to obtain separated larger sized unscreened particulates in the first compartment and smaller sized screened particulates in a second compartment, and supplying a pressurized gas to the second compartment of the screening device through a second gas permeable layer of the second compartment for fluidization of at least a portion of the smaller sized screened particulates in the second compartment.

8. Method according to claim 7, wherein a level of solid particulate material in the first compartment is greater than a level of screened particulates in the second compartment, thereby generating a flow from the first compartment of smaller sized screened particulates to the second compartment.

9. Method according to claim 7, wherein the solid particulate material in the first compartment is fluidized independently of the screened particulates in the second compartment.

* * * * *